US010569996B2

(12) United States Patent
Hämäläinen et al.

(10) Patent No.: US 10,569,996 B2
(45) Date of Patent: Feb. 25, 2020

(54) ROPE GUIDE OF ROPE DRUM IN CRANE

(71) Applicant: KONECRANES GLOBAL CORPORATION, Hyvinkää (FI)

(72) Inventors: Mika Hämäläinen, Hämeenlinna (FI); Matti Hyvönen, Oitti (FI); Willem Pelt, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 266 days.

(21) Appl. No.: 15/516,241

(22) PCT Filed: Oct. 19, 2015

(86) PCT No.: PCT/FI2015/050708

§ 371 (c)(1),
(2) Date: Mar. 31, 2017

(87) PCT Pub. No.: WO2016/062920

PCT Pub. Date: Apr. 28, 2016

(65) Prior Publication Data

US 2017/0240392 A1 Aug. 24, 2017

(30) Foreign Application Priority Data

Oct. 20, 2014 (FI) ..... 20145917

(51) Int. Cl.
*B66D 1/38* (2006.01)
*B66D 1/36* (2006.01)

(52) U.S. Cl.
CPC ..... *B66D 1/38* (2013.01); *B66D 1/36* (2013.01)

(58) Field of Classification Search
CPC ..... B66D 1/36; B66D 1/38
See application file for complete search history.

(56) References Cited

U.S. PATENT DOCUMENTS 1,782,358 A * 11/1930 Lang ..... B66D 1/36 242/157.1
1,973,446 A * 9/1934 Resenquist ..... B66D 1/38 242/483

(Continued)

FOREIGN PATENT DOCUMENTS

BG 64254 B1 7/2004
CN 1939835 A 4/2007

(Continued)

OTHER PUBLICATIONS

Chinese Office Action and Search Report for Chinese Application No. 201580056709.6, dated Jul. 25, 2018, with English translation of the Office Action.

*Primary Examiner* — Emmanuel M Marcelo
(74) *Attorney, Agent, or Firm* — Birch, Stewart, Kolasch & Birch, LLP

(57) ABSTRACT

A rope guide of a rope drum in a crane surrounds the rope drum and keeps the hoisting rope in a spiral rope groove of the rope drum when the hoisting rope is wound into the rope groove or unwound from it. The rope guide includes a body that is made up of several parts and surrounds the rope drum; a rope guide element at a winding/unwinding point of the hoisting rope; a hoisting rope retainer for pressing the hoisting rope into the rope groove; and several guide members distributed on the circumference of the rope guide and arranged to move on a surface of the rope drum or the hoisting rope to guide the hoisting rope being wound onto the rope drum or unwound from it. The body is a chain-like entity including chain links interconnected to form a ring-like entity extending around the entire rope drum, to which entity the rope guide element, hoisting rope retainer and control members are installable.

18 Claims, 5 Drawing Sheets

(56) References Cited

U.S. PATENT DOCUMENTS

| | | | | | |
|---|---|---|---|---|---|
| 2,926,867 | A * | 3/1960 | Nardone | B66D 1/36 | 242/397.3 |
| 3,226,090 | A * | 12/1965 | Sauerbrey | B66D 1/36 | 242/397.3 |
| 3,353,793 | A * | 11/1967 | Nelson | B66D 1/28 | 254/333 |
| 3,367,633 | A * | 2/1968 | Kratzer | B66D 1/28 | 242/157 R |
| 3,843,094 | A * | 10/1974 | Watts | B66D 1/36 | 242/366 |
| 4,103,841 | A * | 8/1978 | Flynn | B65H 75/425 | 242/390.3 |
| 4,634,078 | A | 1/1987 | Kaufmann et al. | | |
| 4,634,079 | A | 1/1987 | Furomoto | | |
| 4,721,285 | A | 1/1988 | McMichael | | |
| 5,335,895 | A * | 8/1994 | Sell | B66D 1/36 | 242/397.3 |
| 5,482,219 | A * | 1/1996 | Tcholakov | B66D 1/36 | 242/397.3 |
| 5,669,575 | A * | 9/1997 | Byle | B65H 75/4402 | 242/470 |
| 7,374,126 | B2 * | 5/2008 | Kohlenberg | B66D 1/38 | 242/397.3 |
| 7,607,644 | B1 * | 10/2009 | Gibb | B66F 7/02 | 254/333 |
| 9,181,069 | B2 * | 11/2015 | I-Te | B66D 1/38 | |
| 9,382,103 | B2 * | 7/2016 | Seow | B66D 1/36 | |
| 2007/0075174 | A1 | 4/2007 | Kohlenberg et al. | | |
| 2010/0032509 | A1 * | 2/2010 | Cazzaro | B66D 1/38 | 242/397.3 |
| 2010/0314594 | A1 | 12/2010 | Seow | | |
| 2017/0320711 | A1 * | 11/2017 | Hampton | B66D 1/38 | |

FOREIGN PATENT DOCUMENTS

| | | | | | |
|---|---|---|---|---|---|
| CN | 102502440 | A | | 6/2012 | |
| CN | 203095478 | U | | 7/2013 | |
| CN | 102502440 | B | | 3/2014 | |
| CN | 203728465 | U | | 7/2014 | |
| CN | 104860219 | A | | 8/2015 | |
| DE | 1531291 | A1 | * | 3/1970 | B66D 1/36 |
| DE | 1756387 | | | 4/1970 | |
| DE | 3421843 | A1 | | 12/1985 | |
| DE | 20 2014 002 972 | U1 | | 4/2014 | |
| GB | 319941 | A | * | 10/1929 | B66D 1/36 |
| GB | 1078755 | A | * | 8/1967 | B66D 1/28 |
| JP | 2000-351580 | A | | 12/2000 | |
| JP | 2016-8125 | A | | 1/2016 | |

* cited by examiner

ROPE GUIDE OF ROPE DRUM IN CRANE

BACKGROUND OF THE INVENTION

The invention relates to a rope guide of a rope drum in a crane, the rope guide surrounding the rope drum and keeping a hoisting rope in a spiral rope groove of the rope drum when the hoisting rope is wound into the rope groove or unwound from it, whereby the rope guide comprises a body that is made up of several parts and surrounds the rope drum; a rope guide element at a winding/unwinding point of the hoisting rope; hoisting rope retaining means for pressing the hoisting rope into the rope groove; and several guide members distributed on the circumference of the rope guide and arranged to move on a surface of the rope drum or the hoisting rope to guide the hoisting rope being wound onto the rope drum or unwound from it.

Rope guides of this type are previously known and there are numerous different versions of them. A general problem with them is the difficulty of their installation and maintenance. Some models also require special tools for this work. Installation and maintenance work cannot be avoided, since a rope guide is classified as a wearing part of a crane. Sometimes, a rope guide is also misused, which speeds up its wear and the need to replace it.

Known rope guides are typically relatively massive entities, which means that it is possible to use heavy cast-iron structures, for instance. In addition, each rope guide on the market is almost invariably suitable for only one rope drum model and size, so, in practice, only tolerance variations are allowed for the diameter of the rope drum and the pitch of the rope groove.

Also, several rope guides are not only susceptible to wear, but also cause wear in the rope drum and hoisting rope. Wear in a rope drum is especially extensive, if the run of the rope guide in the rope drum groove is implemented by an element that trails at the bottom of the rope groove. Elements coming into contact with a rope are often also made of rope-wearing materials.

Some examples of rope guides representing the closely related prior art are disclosed in publications U.S. Pat. Nos. 4,634,079, 5,335,895, and 5,482,219, for example. The above-mentioned drawbacks also occur in these.

SUMMARY OF THE INVENTION

It is, thus, an object of the invention to provide a novel type of rope guide which has a more universal structure and with which the above-mentioned problems can be solved. This object is achieved by the rope guide of the invention that is characterised in that the body is a chain-like entity comprising chain links that are interconnected so as to form a ring-like entity extending around the entire rope drum, to which entity a rope guide element, hoisting rope retaining means and guide members are installable.

In one preferred embodiment the chain-like entity comprises parallel chain links in an axial direction of the chain drum, the links being attached to each other in a circumferential direction of the chain drum and to an adjacent chain link available in each case in the axial direction of the rope drum, the adjacent chain links in the body thus forming spaces between them into which the rope guide element, hoisting rope retaining means and the guide members are installable.

The other preferred embodiments of the invention are disclosed in the dependent claims.

The invention is based on an open modular structure of the body that allows a great deal of freedom in positioning the different components of the rope guide and for new implementations.

The open modular body structure according to the invention makes it possible to easily and advantageously implement the rope guide for rope drums of different sizes, with a smaller range of rope drum diameter and very small alterations in one and the same rope guide, and even without adding more chain links. However, the structure permits a limitless attachment of these joint parts. In addition, the openness of the body not only permits the positioning of the basic elements of the rope guide inside it, but also the installation of limit switches, sensors, and elements keeping the rope groove clean in the open space of the body. The openness of the body also makes it possible to easily keep the rope guide clean and to visually inspect the different components thereof.

One very advantageous implementation of the chain guide according to the invention is to fasten the guide members to selected points in the space between the chain links by joints that connect opposite chain links and form a bearing point for the guide members, in which the location of consecutive guide members is adjustable to correspond to the pitch of the rope groove and in which the location of the guide members is switchable according to the handedness of the rope groove in the rope drum. In order not to wear the rope groove, the guide members are preferably made of a synthetic material.

LIST OF FIGURES

The invention will now be explained in more detail with reference to the accompanying drawings, in which FIG. 1 is a perspective view of a rope guide according to the invention installed on a rope drum;

DETAILED DESCRIPTION OF THE INVENTION

Figure 1:
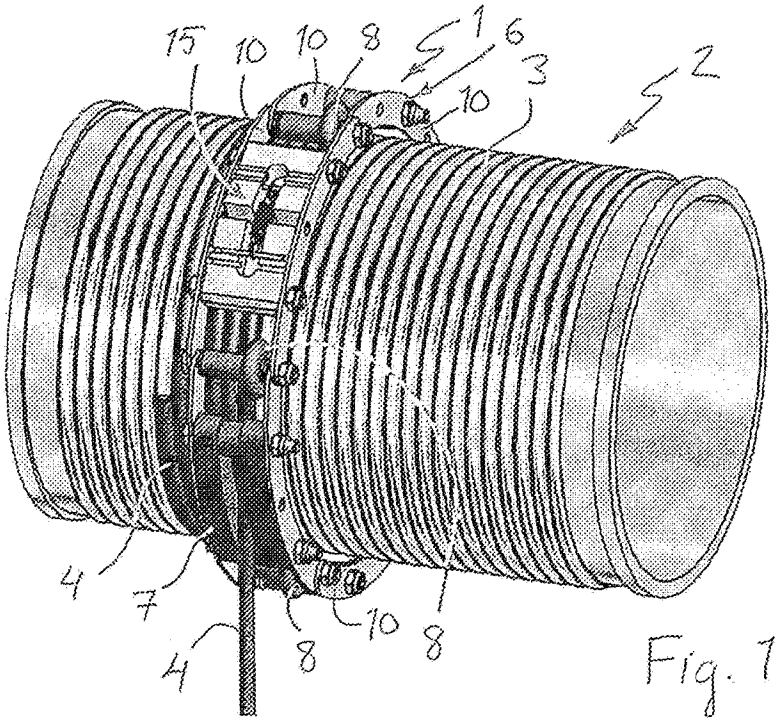

In FIG. 1, the rope guide 1 of the invention is shown installed on a rope drum 2 of a crane. The rope drum 2 has a spiral rope groove 3 with a hoisting rope 4 wound therein. In such a case, the rope guide 1 surrounds the rope drum 2 and, at the same time, also the hoisting rope 4 in it. The purpose of the rope guide 1 is to keep the hoisting rope 4 in the spiral rope groove 3 of the rope drum 2, especially when the hoisting rope 4 is wound in the rope groove 3 or unwound from the rope groove 3. When the rope drum 2 is used, the rope guide 1 thus moves on top of the rope drum 2 to the right or left in the axial direction depending on whether the hoisting rope 4 is wound on the rope drum or unwound from it. Only part of the hoisting rope 4 is shown and its fastening to the rope drum 2 is not shown.

Figure 2:
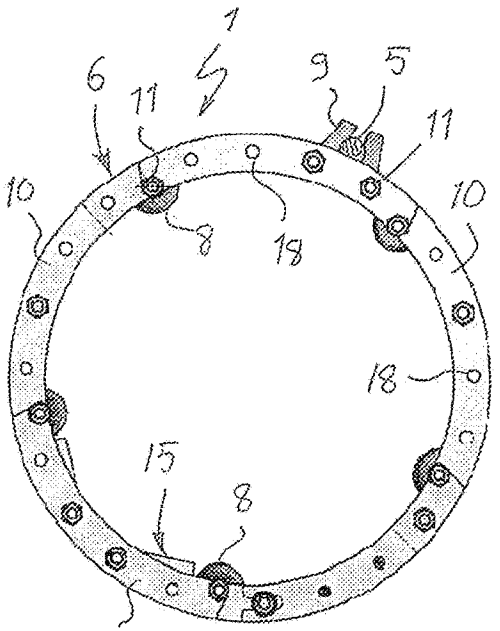
FIG. 2 is a side view of the rope guide shown in FIG. 1.
Figure 3:
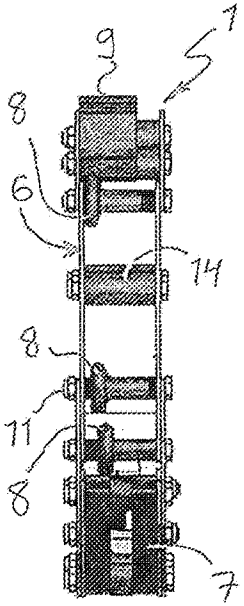
FIG. 3 is a front view of the rope guide shown in FIG. 1.

With reference to the other figures of the drawings, the rope guide 1 comprises a body 6 that is made up of several parts 10, 12 and surrounds the rope drum 2. On this body 6, the following are installed: a rope guide element 7 at the winding/unwinding point of the hoisting rope, hoisting rope retaining means for pressing the hoisting rope 4 into the rope groove 3, the retaining means consisting of elements to be described below, and several guide members, which in this example are guide rolls 8, distributed on the circumference of the rope guide 1 and arranged to rotate in the rope groove 3 beside the hoisting rope 4 wound therein or unwound therefrom. The guide rolls 8 permit the above-mentioned axial movement of the rope guide 1 on top of the rope drum 2. So as to prevent the rope guide 1 from rotating with the rope drum 2, the body 6 also has a rotation prevention element 9 that is fastened to a slide rod 5 on the support frame of the rope drum 2 (FIG. 2).

In the implementation shown in the drawings, the body 6 is a chain-like entity that comprises on both sides of the body 6 chain links 10 that are attached consecutively to each other and to a chain link 10 on the opposite side at each time, whereby, on the opposite sides of the body 6, the chain links 10 form between them a space, into which the rope guide element 7, hoisting rope retaining means, guide rolls 8 and here also the rotation prevention element 9 are installed.

Said consecutive chain links 10 on opposite sides of the body are attached to each other by bolted joints 11, for instance, whereby the joints of the chain links 10 on opposite sides of the body 6 are made with the same bolted joints 11.

Figure 4:
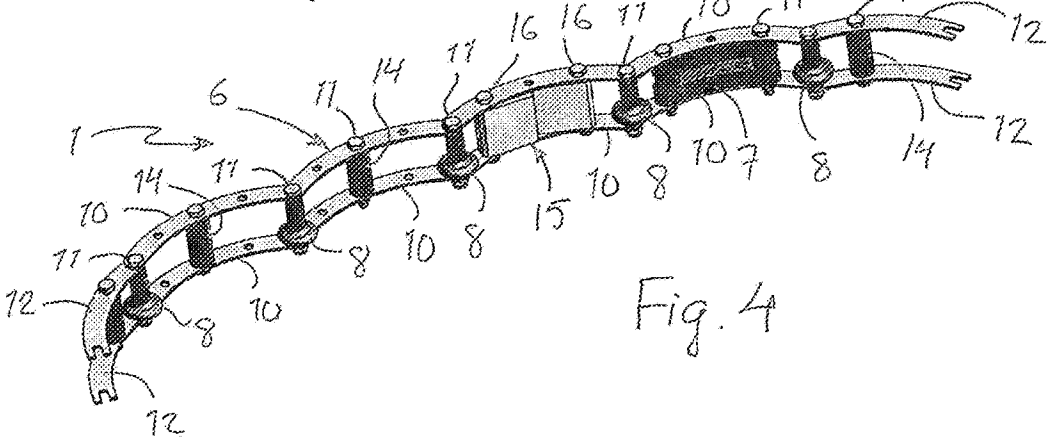
FIG. 4 shows the rope guide shown in FIG. 1 in an opened state.
Figure 5:
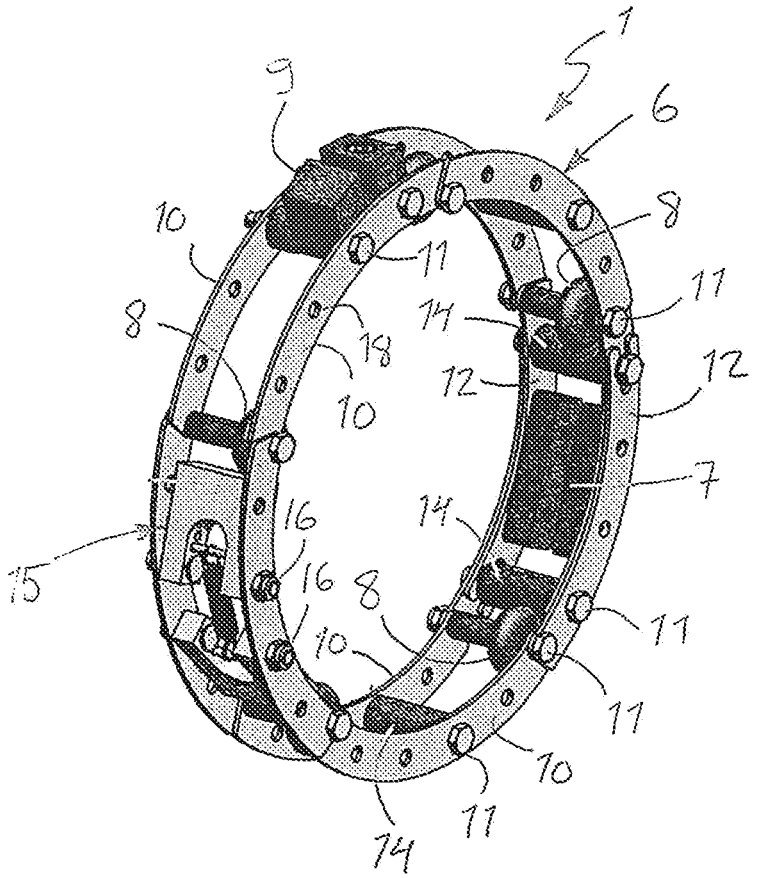
FIG. 5 is a perspective view of the rope guide according to FIG. 1 with its components at slightly different locations of the body than in FIG. 1.
Figure 10:
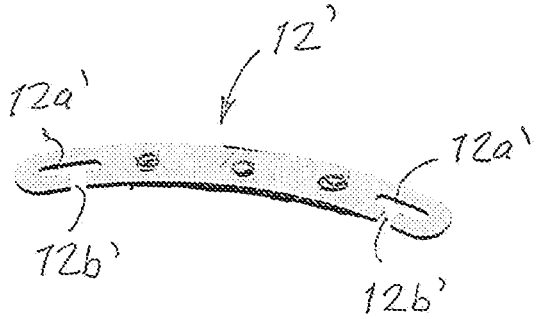
FIG. 10 shows an alternative chain link of the opening point of the body.
Figure 6:
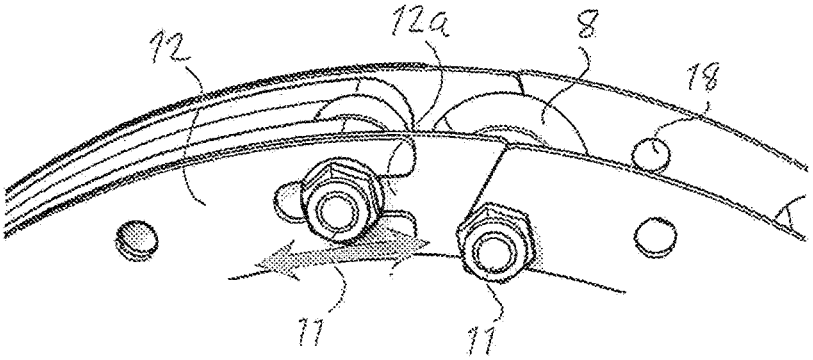
FIG. 6 shows the opening point of the body of the chain guide shown in the previous figures.

At least one consecutive joint of chain links is made to be adjustable in the circumferential direction of the rope drum 2. In FIG. 4, the chain links of this joint are marked with reference marking 12. In FIG. 4, the bolted joints 11 of the body 6 are shown loosened and the body 6 opened into a "snake-like" piece, in which the chain links 12 are at opposite ends of the cut-off point of the body 6. At the ends of the chain links 12, there are open slots 12*a* for the bolted joints 11 (see also FIG. 6). When the body 6 is closed, these opposite chain links 12 intermesh. Alternatively, the chain links 12 intended for the opening point of the body 6 can be replaced by the chain link 12' shown in FIG. 10, which has at both ends slots 12*a*' that are closed at the ends of the chain link 12' but have an access point 12*b*' from below for the bolted joints 11. Only one of these chain links 12' is needed on both sides of the body 6 to form an adjustable opening point for the chain guide 1.

At least some of the bolted joints 11 of the chain links 10, 12, 12' are used in the fastening of the above-mentioned components 7, 8, 9 to be installed in the space between the chain links 10, 12, 12', for example. This depends on where these components are to be fastened on the body 6.

So as to permit the fastening of the components 7, 8, 9 exactly to the desired and selectable point, the chain links 10, 12, 12' have extra bolt holes 18 on opposite sides of the body 6.

As revealed by what is stated above, all other chain links 10 except the chain links 12, 12' of the above-mentioned opening point are substantially similar and, therefore, interchangeable. The only difference between these chain links 10 and 12, 12' is that the chain links 12, 12' have a slot structure for the bolted joints 11 instead of a normal hole.

The chain links 10, 12, 12' are preferably laser-cut plate-like pieces of stainless steel. In addition, they are curved as seen from the side in such a manner that they conform to the circumference of the rope drum 2 being used.

The rope guide 1 of the invention can be used in rope drums 2 having different diameters, since at least the circumferential adjustability arranged at its opening point and the adding or reducing of chain links 10 provides extensive options for this. However, when adding chain links 10 or reducing chain links 10, there should be a sufficient number of them, they need to be suitably short or some of them possibly of slightly different lengths so that the chain guide 1 conforms to the rope drum 2 in a correct manner. The bolted joints of the body 6 are intended to be slightly loose before the rope guide 1 is positioned in place so that its installation on top of the rope drum 2 is easy. It is only necessary to tighten the bolted joints and to adjust the opening/closing point in such a manner that the guide rolls 8 rotate with a suitable friction.

Figure 7:
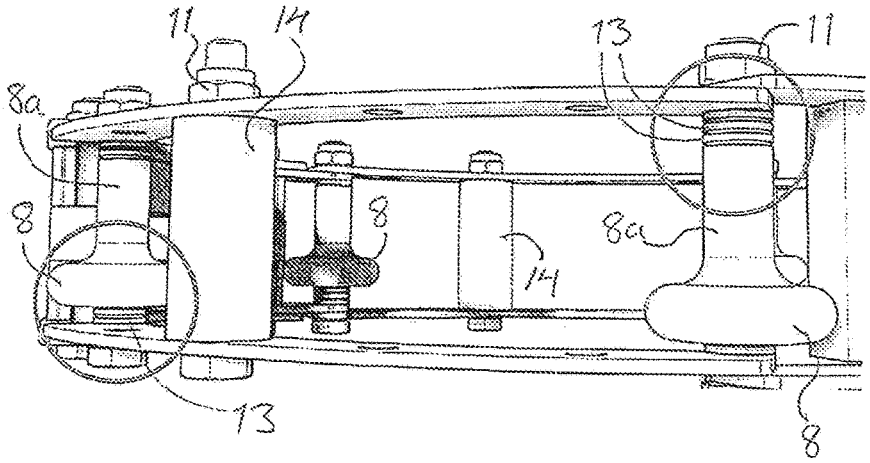
FIG. 7 shows the guide rolls shown in the previous figures in more detail.

The guide rolls 8 are fastened to the space between the chain links 10, 12 at selected points, herein to the connecting points of the chain links 10, 12, with bolted joints 11 connecting opposite chain links 10, 12, which at the same time form a bearing axle of the guide rolls 8, in which the location of the consecutive guide rolls 8 is adjustable to correspond to the pitch of the rope groove 3 and the location of the guide rolls 8 is switchable according to the handedness of the rope groove 3 on the rope drum 2. Here, the location of the guide rolls 8 on the bearing axle is adjusted by axial adjustment pieces 13 installable thereon. When the guide rolls 8 are made of a synthetic material and formed into "mushroom-like" pieces shown in the figures that have a rotating arm 8*a* on top of the bearing axle, i.e. bolted joint 11, this arm 8*a* may be provided with rings that are easily cuttable from it and can be used as said adjustment pieces 13 on one side of the guide roll 8. Guide rolls 8 made of a synthetic material are extremely advantageous in the sense that they do not wear the rope groove 3 similarly as rolls made of metal would. The cross-sectional profile of the guide roll 8 rolling in the rope groove 3 naturally corresponds to that of the rope groove 3. The diameter of said arms 8*a* can be made in such a manner that the arms press the hoisting rope 4 against the rope drum 2 and thus form part of the above-mentioned retaining means of the hoisting rope 4. The above-mentioned structure of the guide roll 8 is best shown in FIG. 7.

Rotating guide rolls 14 are mounted by bolted joints 11 in extra bolt holes 18 at selected points to rotate on top of them, the guide rolls pressing against the hoisting rope 3 and also serving as retaining means for the hoisting rope 4.

Figure 8:
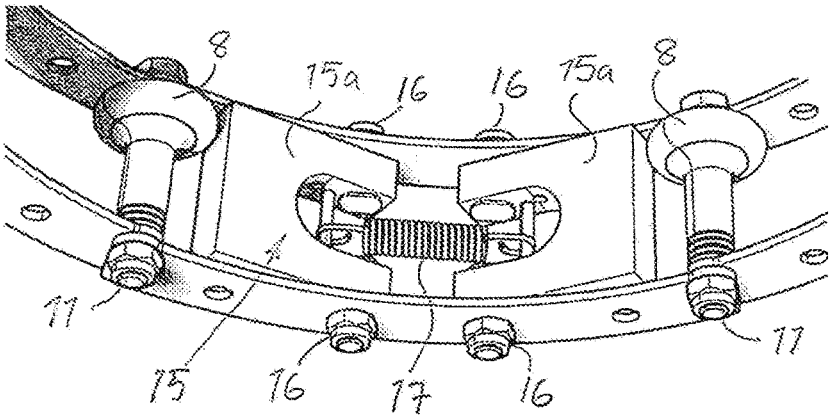
FIG. 8 shows a rebound prevention element of the hoisting rope shown in the previous figures in more detail.

The retaining means of the hoisting rope 4 also comprise a rebound prevention element 15 located before the rope guide element 7 (above the rope guide element 7), because at this point the hoisting rope 4 needs to be carefully kept in the rope groove 3. As shown in FIG. 8, in particular, this rebound prevention element 15 comprises two oppositely functioning halves 15*a* that are fastened to the space between the chain links 10 by bolted joints 16, while the halves 15*a* are connected to each other by a spring 17 that forces the free ends of the halves 15*a* to twist in the bolted joints 16 and to press against the hoisting rope 3 on the rope drum 2. The halves 15*a* of the rebound prevention element 15 are made of a synthetic material that does not damage the hoisting rope 3 when rubbing against it.

Figure 9:
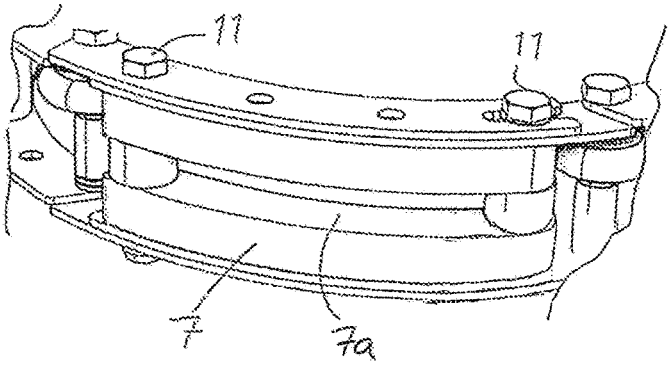
FIG. 9 shows the rope guide element shown in the previous figures in more detail.

The rope guide element 7, which has a central longitudinal gap 7*a* for the hoisting rope 4, is shaped so as to form at the same time an element preventing the rope guide from tilting. Also the rope guide element 7 is made of a synthetic material. The structure of the rope guide element is best seen in FIG. 9.

Figure 11:
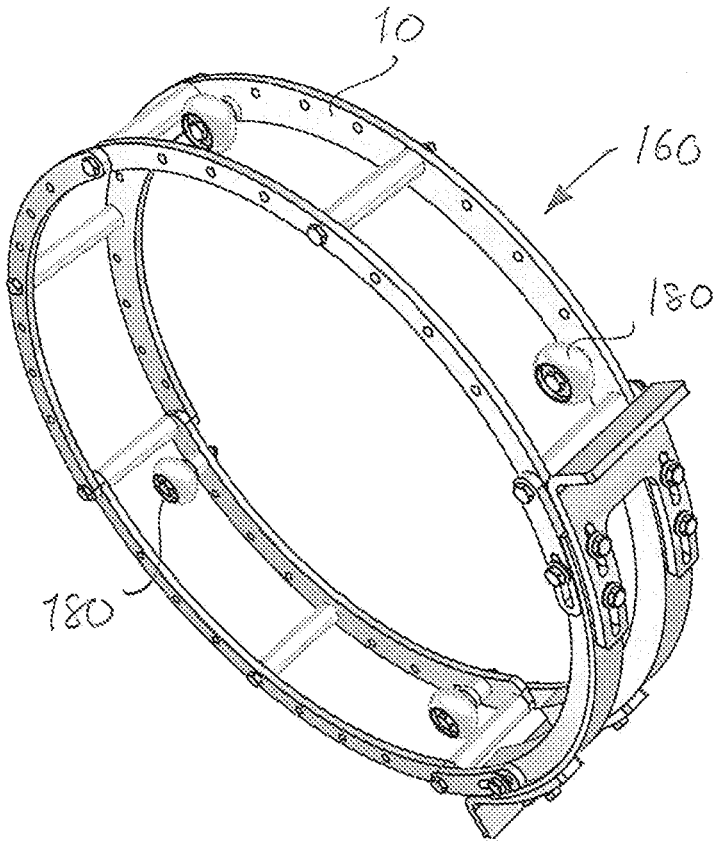
FIGS. 11 to 13 show some alternative implementations of the invention.

FIG. 11 shows an alternative chain-like entity of the invention, which forms a body 160 of the chain guide and is substantially similar to the chain-like entity of two rings shown in the previous figures except that here the guide members 180 are mounted on bearings one-sidedly to the body 160, i.e. only to one of its rings.

Figure 12:
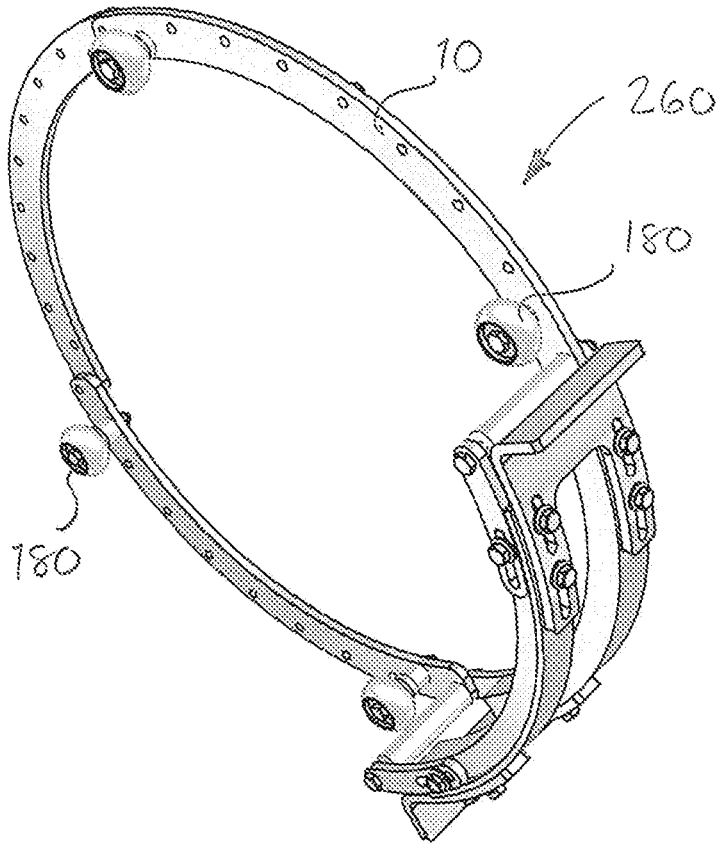

FIG. 12 shows a second alternative chain-like entity of the invention, which forms a body 260 of the chain guide and comprises only one ring. Here the guide members 180 are similar to those in FIG. 12.

Figure 13:
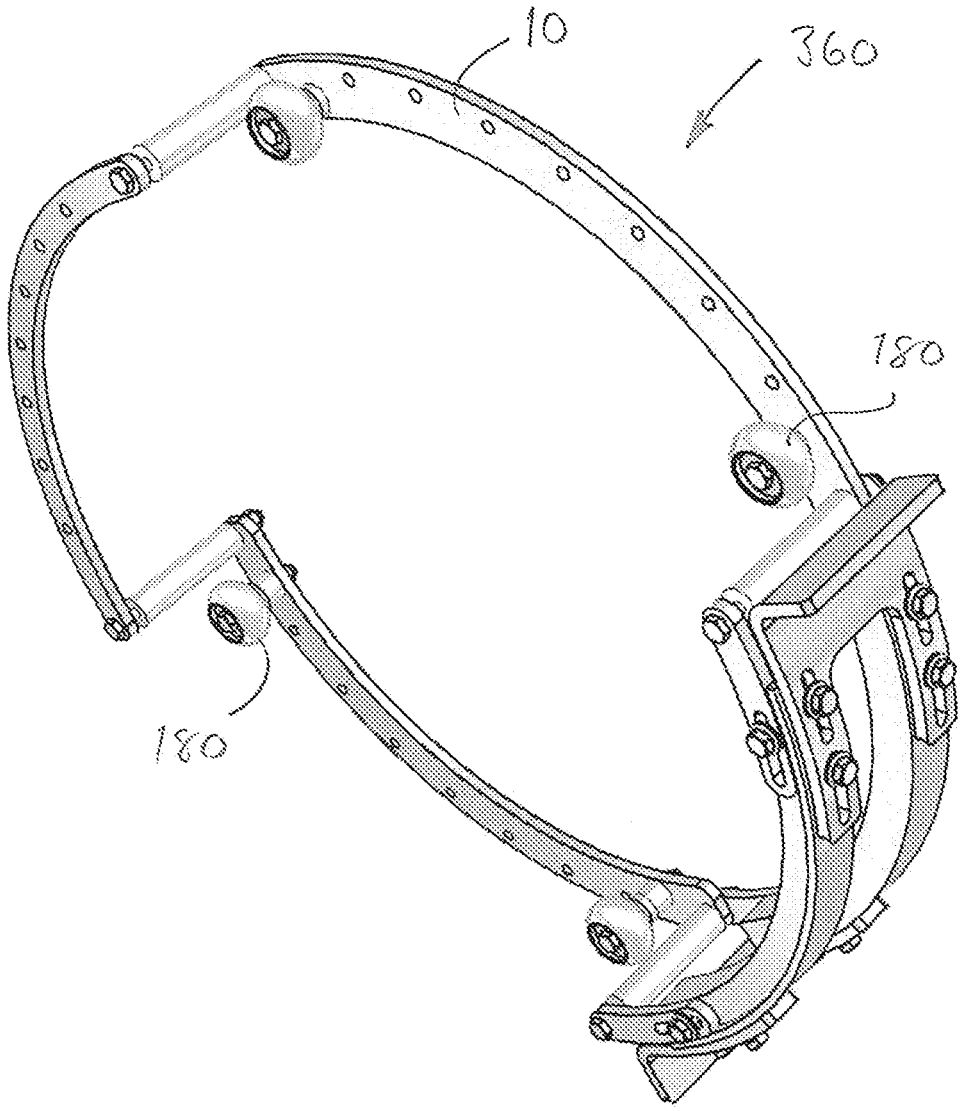

FIG. 13 shows a third alternative chain guide body 360 of the invention, which has one ring but part of the ring is offset in the axial direction of the rope drum 2. Here the guide members 180 are similar to those in FIGS. 11 and 12.

The above description of the invention is only intended to illustrate the basic idea of the invention. A person skilled in the art may thus vary its details within the scope of the attached claims.

The invention claimed is:

1. A rope guide of a rope drum in a crane, the rope guide surrounding the rope drum and keeping a hoisting rope in a spiral rope groove of the rope drum when winding the hoisting rope into the rope groove or unwinding it from the rope groove, whereby the rope guide comprises:

a body that is made up of several parts and surrounds the rope drum;

a rope guide element at a winding/unwinding point of the hoisting rope;

a hoisting rope retainer for pressing the hoisting rope into the rope groove; and several guide rolls that are distributed on the circumference of the rope guide and arranged to move on a surface of the rope drum or the hoisting rope to guide the hoisting rope being wound onto the rope drum or unwound from the rope drum, wherein the body is a chain comprising chain links that are interconnected so as to form a ring extending around the entire rope drum, to which entity guide members, the rope guide element and the hoisting rope retainer are installable, and where in at least most of the chain links are substantially similar and, therefore, interchangeable, and wherein the chain comprises parallel chain links in an axial direction of a chain drum, the links being attached to each other in a circumferential direction of the chain drum and to an adjacent chain link available in each case in the axial direction of the rope drum, the adjacent chain links in the body thus forming spaces between them into which the rope guide element, hoisting rope retainer and the guide members are installable.

2. The rope guide as claimed in claim 1, wherein the chain comprises one chain link entity in which each chain link always connects to a next chain link to form the ring.

3. The rope guide as claimed in claim 1, wherein said consecutive chain links on opposite sides of the body are attached to each other by joints, whereby the joints on opposite sides of the body are made with the same joints.

4. The rope guide as claimed in claim 3, wherein at least one consecutive joint of chain links is adjustable in the circumferential direction of the rope drum.

5. The rope guide as claimed in claim 4, wherein at least some of the joints of the chain links are used in the fastening of components to be installed in the space between the chain links.

6. The rope guide as claimed in claim 3, wherein at least some of the joints of the chain links are used in the fastening of the components to be installed in a space between the chain links.

7. The rope guide as claimed in claim 1, wherein in the chain links on opposite sides of the body, there are extra holes for fastening components to be mounted in a space between the chain links.

8. The rope guide as claimed in claim 1, wherein the chain links are laser-cut plate shaped pieces of stainless steel.

9. The rope guide as claimed in claim 1, wherein the guide members are fastened to selected points in the space between the chain links by joints connecting opposite chain links and forming a bearing point for the guide members, in which the location of consecutive guide members is adjustable to correspond to a pitch of the rope groove and in which the location of the guide members is switchable according to the handedness of the rope groove in the rope drum.

10. The rope guide as claimed in claim 9, wherein the location of the guide members on the bearing point is implemented to be according to the required pitch by axial adjustment pieces to be mounted thereto, a grooved axle or pairs of springs of different lengths.

11. The rope guide as claimed in claim 1, wherein the guide members are made of metal or of a synthetic material.

12. The rope guide as claimed in claim 1, wherein the hoisting rope retainer comprises a rebound prevention element of the hoisting rope with two oppositely functioning halves that are fastened to a space between the chain links at a selected point, and wherein the halves are connected to each other by a spring that forces free ends of the halves to twist in joints and to press against the hoisting rope on the rope drum.

13. The rope guide as claimed in claim 12, wherein the halves of the rebound prevention element of the hoisting rope are made of wear-resistant steel, ceramics, rubber, bronze or synthetic material.

14. The rope guide as claimed in claim 1, wherein the hoisting rope retainer comprises guide member arms that rotate on top of joints that form their bearing axles.

15. The rope guide as claimed in claim 1, wherein the hoisting rope retainer comprises guide rolls that rotate on top of joints and press against the hoisting rope.

16. The rope guide as claimed in claim 1, wherein the rope guide element is made of bronze, aluminium, steel or a synthetic material.

17. The rope guide as claimed in claim 1, wherein in the chain links on opposite sides of the body, there are extra holes at several selectable locations for fastening components to be mounted in a space between the chain links.

18. The rope guide as claimed in claim 1, wherein the guide members are made of bronze.

* * * * *